United States Patent [19]

Vignaud

[11] 4,277,666

[45] Jul. 7, 1981

[54] SWITCH PUSH BUTTON LOCK

[75] Inventor: Jean C. Vignaud, Angouleme, France

[73] Assignee: La Telemecanique Electrique, France

[21] Appl. No.: 139,481

[22] Filed: Apr. 11, 1980

[30] Foreign Application Priority Data

Apr. 13, 1979 [FR] France ..... 79 09416

[51] Int. Cl.[3] ..... H01H 9/20

[52] U.S. Cl. ..... 200/328; 200/320; 200/321; 200/327

[58] Field of Search ..... 200/328, 327, 320, 321, 200/322, 318, 298

[56] References Cited

U.S. PATENT DOCUMENTS

| | | | |
|---|---|---|---|
| 3,370,481 | 2/1968 | Mekelburg et al. | 200/328 |
| 3,487,177 | 12/1969 | Shea | 200/328 |
| 3,970,806 | 7/1976 | Distler | 200/328 |

*Primary Examiner*—Willis Little

*Attorney, Agent, or Firm*—William A. Drucker

[57] ABSTRACT

A locking device prevents simultaneous displacement of two slides in a common plane, each slide being associated with a respective push button. Each slide is returned by a respective spring, and has a ramp and a notch directed towards a bolt placed between the slides and capable, by actuation of a push button, of moving to a working position to prevent movement of the other push button. The improvement is that the bolt is kept at a central rest position, equidistant from the ramps, by a resilient element. When the bolt is placed in working position by actuation of a first push button, actuation of the second push button causes the bolt to be kept in that position. In the working position, there is complete absence of any contact, between the bolt and the first slide, which might otherwise prevent the return movement of the first slide.

4 Claims, 6 Drawing Figures

SWITCH PUSH BUTTON LOCK

BACKGROUND OF THE INVENTION

The invention relates to a locking device for preventing the simultaneous displacement of two slides movable in a common plane, in particular for two slides each associated with a respective one of two push buttons, each slide being associated with a return spring and being provided with a ramp and with a notch which are both directed towards a same bolt which is placed between them and which is capable of being displaced, when one of the push buttons is actuated, into a working position in which this bolt prevents the displacement of the other push button.

Such devices are particularly used to avoid short circuits which can arise during the excitation of a motor, for example that of a lifting motor, during the period of reversal of the direction of rotation.

THE PRIOR ART

The locking devices known in the prior art avoid in a satisfactory manner the simultaneous actuation of two push buttons intended to cause the reversal of movement mentioned above.

Nevertheless, it can happen that if the precaution of permitting one of the buttons to return to its rest position has not been taken before exerting a pressure on the other button, the first button can become locked, which may cause accidents.

Furthermore, if such a locking has not been caused by reason of the release of the push button which has just been actuated, the succession of switching operations resulting from the actuation of the other push button can take place in an interval of time which is so short that, in spite of mechanical disconnection of the contacts, a short circuit can be established by arcs passing between the contact elements during an interval of time the duration of which, although very small, causes progressive deterioration of the elements in circuit.

OBJECT OF THE INVENTION

The object of the invention is accordingly to improve a device known in the prior art by applying thereto complementary features adapted to remedy the inconveniences mentioned above.

SUMMARY OF THE INVENTION

According to the invention, this result is obtained by reason of the fact that the bolt is maintained at rest in a central position, at equal distances from the ramps, by a resilient element, when no button is actuated, and in that when this bolt is placed in working position by a first push button, the actuation of the second push button causes a maintaining of the bolt in the said position, and in that in the working position, no contact capable of preventing the return movement of the first slide is established between the bolt and the first slide.

The invention likewise relates to different forms of construction which can have specific advantages in their application to particular arrangements.

BRIEF DESCRIPTION OF THE DRAWINGS

The invention will be better understood from the following description with respect to the drawings, wherein.

DESCRIPTION OF THE PREFERRED EMBODIMENT

In the example of use given below the locking device is applied to a switching apparatus controlling the forward and reverse movements of the motor of a lifting device, with the aid of the pressure exerted by an operator on one of the two press buttons.

Figure 1:
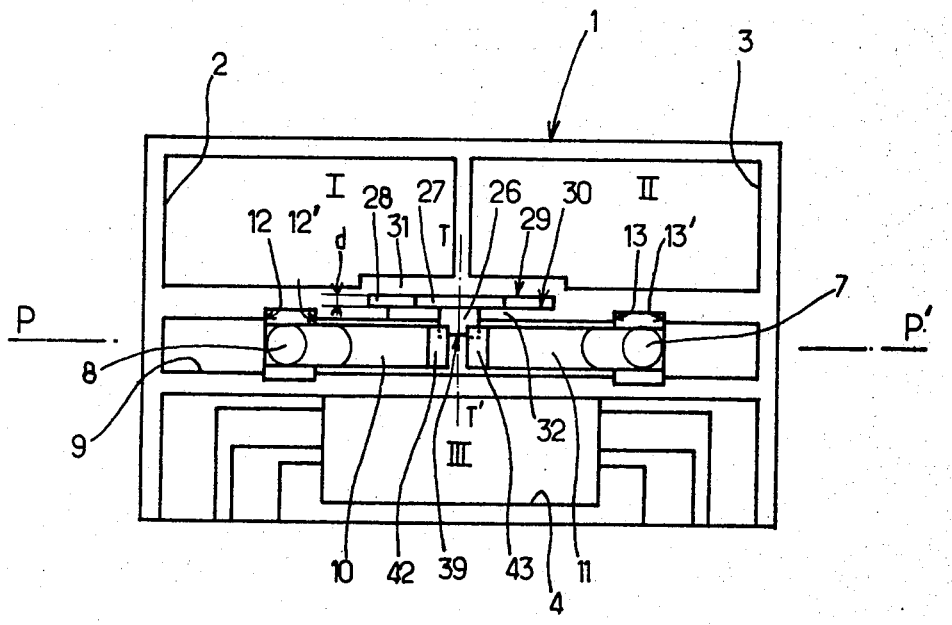
FIG. 1 shows a plan view of an apparatus equipped with a locking device in accordance with a first manner of construction.

The switching apparatus seen in FIG. 1 comprises an insulating housing 1 in which are provided two chambers 2 and 3 to receive two switches I and II (not shown) and a third chamber 4 receiving internal contacts III (not shown).

Figure 2:
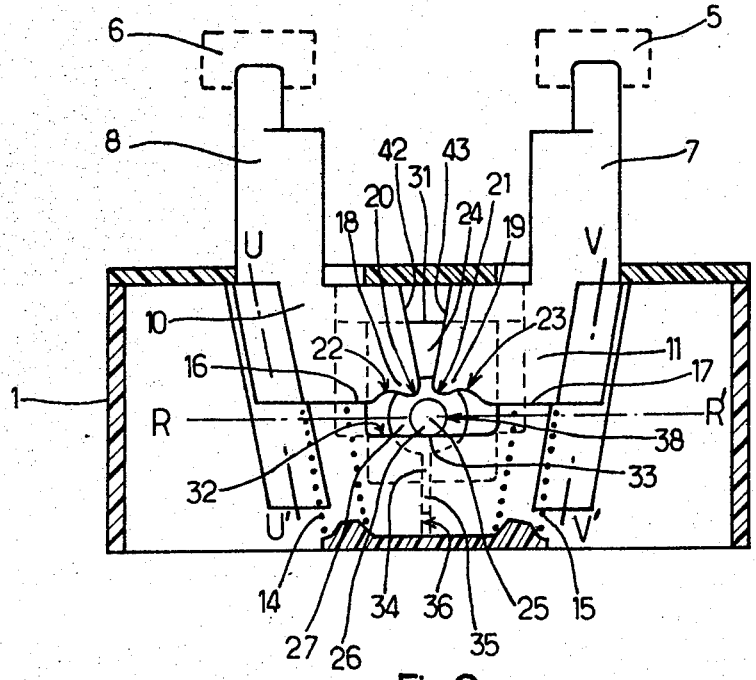
FIG. 2 shows a view in elevation of the apparatus of FIG. 1 taken in section on a median plane PP'.

When a pressure is exerted on one of the two push buttons 5, 6 coupled respectively to the transmission rods 7 and 8, there is produced for example the successive actuation of the switches I and III, and when the other push button is manipulated, the successive actuation of the switches II and III (see likewise FIG. 2).

A chamber 9 extending about a median plane PP' which separates the chambers 2 and 3 from the chamber 4, receives two slides 10, 11 which respectively carry rods 7 and 8 and which move towards the bottom of the drawing, along guiding surfaces 12, 12' and 13, 13' respectively, whilst compressing respective springs 14, 15 in this chamber.

In the manner of construction shown, the guiding surfaces are directed along the concurrent axes UU', VV' in the plane PP', but these surfaces could be parallel.

Each of the lower regions 16 and 17 of the two slides carries a respective hook 18, 19 having a nose 20,21 respectively forming a ramp 22 and a notch 23. Lateral surfaces respectively parallel to UU' and VV' extend the noses at the side opposite from the notches. These two noses are disposed in the vicinity of each other in a central region 24 of the chamber where there is disposed a bolt 25 (see FIGS. 1 and 2).

This bolt is constituted by a first disc 26 fast to a second disc 27 of greater diameter.

The second disc is disposed in a chamber 28, open towards the top of the drawing, which comprises two internal parallel guiding surfaces 29 and 30. The surface 29 is bounded by an edge 31, whilst the surface 30 is bounded by a rectilinear edge 32 terminating at the chamber 9 and the surface of which is disposed in a plane perpendicular to the plane PP'.

The second disc 27, which has a thickness slightly less than the width d of the chamber 28, is guided in its plane by the guiding surfaces, whilst the first disc 26 lies along a generatrix 33 on the edge 32 and enters a small distance into the chamber 9 (see FIG. 1).

A resilient tailpiece 34, integral with the bolt and forming an extension thereof, is disposed in the plane of the second disc, and has an extremity 35 which is disposed in a groove opening in the base 37 of the housing 29, parallel to the bisector of the directions UU' and VV' and from the side opposite to the noses with respect to RR'; the tailpiece can move by sliding in the groove and, in the absence of external force, imparts to the bolt a central rest position which places the first disc at equal distances from the two noses.

The first disc has a thickness such that its external cylindrical surface 38, in the vicinity of its extremity 39 opposite to the second disc, is situated on the paths followed by the noses when the slides are pushed in.

In the example shown, the two discs are concentric with a same axis TT', and thus the projection on the plane of the drawing moves along the straight line RR'.

Figure 3:
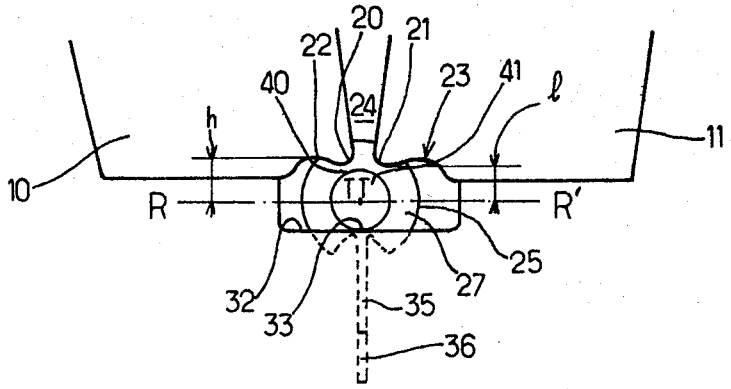
FIG. 3 shows a detail of the region where the bolt is situated, when the slides are at rest.

The noses 20, 21 (see FIG. 3) are placed at a distance P from this straight line, which is less than the distance h which separates this same straight line from the respective bases 22 and 23 of the notches. When the slides are displaced, the noses are urged towards the bottom of the drawing on the respective generatrices 40 and 41 of the cylindrical surface of the first disc in order to communicate thereto a lateral movement along RR' which is directed towards the right or towards the left, according to whether the left or right hand push button is manipulated.

Figure 4:
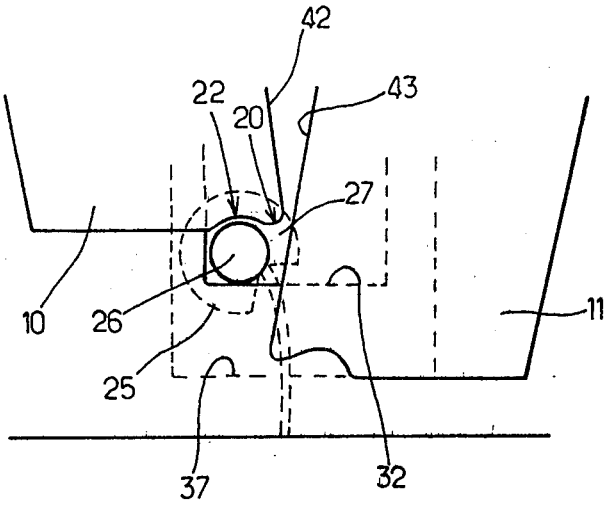
FIG. 4 shows the same members as those of the preceding figures, when one of the slides has been displaced.

When a slide is pushed in, for example the slide 11 of FIG. 4, the cooperation between the ramp of the nose 21, then that of the surface 43 with the disc 26, causes the movement of the bolt towards the left and brings the extremity of the first disc opposite to the notch 22 carried by the slide 10, and this consequently prevents a lowering movement of the slide 10. If a lowering movement of the slide 10 is attempted, the bolt is supported by the nose 20 and the notch 22 of the said slide.

The lateral surface 43 of the slide 11, which is placed opposite to the bolt, moreover prevents the bolt from coming again into the central position, and additionally prevents the push button 6 being able to be actuated for so long as the push button 5 has not been moved up again. If, in the course of a too rapid manipulation, the push button 6 is actuated before the push button 5 has been released, there is no locking of the push button 5 caused by the push button 6, and the release of push button 5 must be followed by the rising up again of the slide 11 before the push button 6 can be actuated.

Moreover, if it is desired at this moment to be able to push in the push button 6, it will be necessary to again release the pressure on the latter in order that the return spring 14 may be able to lift it sufficiently and thereby permit the disc 26 of the bolt to escape from the nose 20, under the effect of the resilient tailpiece 34 which urges it to a central position. The successive actuation of the two push buttons thus necessitates the respecting of a certain interval of time. The bolt which has just been described, and which is advantageously made in one piece by molding of an appropriate plastics material, has the useful property of opposing only a very small frictional force against the efforts of lateral displacement exerted by the noses.

Figure 5:
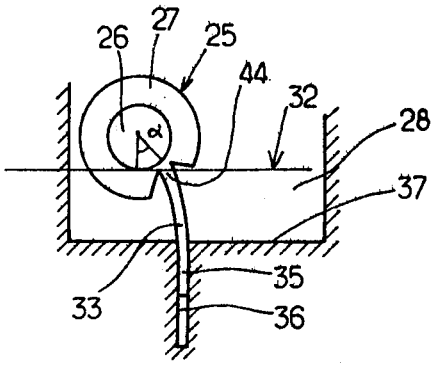
FIG. 5 shows the shape and the position taken up by the bolt in the course of a lateral displacement.

This property is due to the fact that, when the disc moves, see FIG. 5, the extremity 35 of the tailpiece 34 disengages itself slightly from the groove 36 in which it is engaged, by taking up at its root portion 44 a certain curvature which imposes on the belt a small rotation in the same direction as that which would result from a rolling of the surface 38 on the edge 32.

The displacement thus takes place under conditions better than those of simple friction, and wear of the bolt is thereby considerably reduced.

Figure 6:
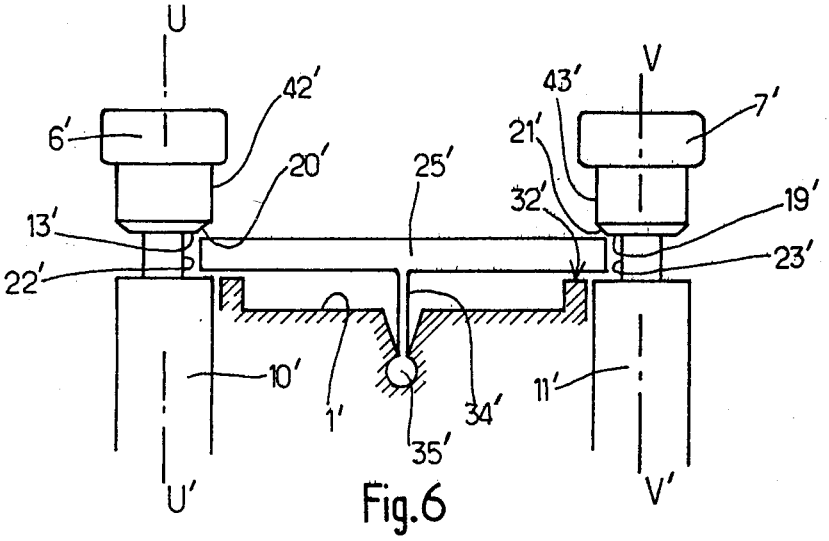
FIG. 6 shows a modified construction.

In the manner of construction seen in FIG. 6, and representing a modification, the elements having the same functions as precedingly are given reference numerals of the same value, accompanied by a supplementary primary index.

The notches 22' and 23' are here represented by recesses formed in the respective parallel slides 10' and 11', and the noses are represented by the respective annular surfaces 18' and 19' of the recesses which are in the vicinity of the respective ramps 20' and 21' extended by the respective lateral surfaces 42' and 43' of the slides.

The bolt 25', of elongated shape, here again carries out a rectilinear path of movement between its two working positions, and it is returned into a central position equidistant from the ramps by a resilient member 34', of which the extremity 35' is lodged in the housing 1'; edges such as 32' serve to receive the bolt bearing thereon if one of the push buttons is actuated at the moment when the bolt has entered into the notch; moreover, the length of the bolt and the position of the surfaces 43', 43' are selected such that, in this case, an effective support of the bolt will be obtained to prevent its lateral displacement.

I claim:

1. A locking device for preventing the simultaneous displacement of two members said locking device comprising: a housing; first and second slides movable in a common plane of said housing between a first and a second position; first and second return springs located in said housing; first and second push buttons respectively associated to said first and second slides and adapted to bring said slides from said first position to said second position when actuated; the first and second slides being respectively associated with the first and second return springs, each of said slides being provided with a ramp and with an adjoining notch; a bolt resiliently connected to said housing and having a central rest position, located between said ramp and notches at equal distance thereof when both of said slides are in their first position, said bolt further having two symetrical working positions, said ramps and said notches being so directed towards said bolt that, when a first slide is displaced from its first to its second position, said bolt is pushed by a corresponding ramp to a working position wherein a subsequent actuation of said second slide establishes a cooperation between said bolt and the notch belonging to said second slide, in which said bolt is maintained in position and in which any engagement between said first slide and said bolt preventing a return movement of said first slide to its second position, is avoided.

2. A locking device, according to claim 1, wherein the said ramp is carried by a respective nose, adjacent to a respective notch and adjacent to a respective lateral surface of the said bolt, and in that the said bolt is movable along a substantially rectilinear path which brings it opposite to one or the other of the notches, and in that the distance which separates the nose from said path is less than the distance which separates the base of the notch from said path.

3. A locking device, according to claim 2, wherein said bolt is constituted by a first flat disc fast with a second flat disc, and wherein said first disc rests by a generatrix on a rectilinear edge of a housing having at least one guiding surface parallel to a median plane, in order to receive the second disc, and in that the resilient element in constituted by an extension of the first disc which slides in a groove in the base of the chamber.

4. A locking device, according to claim 3, wherein the bolt is constituted by a moulded element, and wherein the noses and the extension and the edge are placed at one side and the other of the path followed by the bolt.

* * * * *